United States Patent [19]

Doane

[11] 4,232,490

[45] Nov. 11, 1980

[54] BUILDING CONSTRUCTION FOR MULTIPLE UNITS HAVING COMMON WALLS

[76] Inventor: Cyril M. Doane, 500 Font Blvd., San Francisco, Calif. 94132

[21] Appl. No.: 9,442

[22] Filed: Feb. 5, 1979

[51] Int. Cl.[3] ..... E04B 1/98

[52] U.S. Cl. ..... 52/167; 52/169.2; 52/234; 52/236.3

[58] Field of Search ..... 52/286.3, 169.3, 33, 52/236.2, 169.2, 167, 234

[56] References Cited

U.S. PATENT DOCUMENTS

| | | | |
|---|---|---|---|
| 1,464,189 | 8/1923 | Simonson | 52/169.2 |
| 1,717,546 | 6/1929 | Bemis | 52/236.3 |
| 3,254,458 | 6/1966 | Van Der Lely | 52/169.2 |
| 3,587,197 | 6/1971 | Renfro | 52/73 |

*Primary Examiner*—James L. Ridgill, Jr.
*Attorney, Agent, or Firm*—Julian Caplan

[57] ABSTRACT

A free-standing masonry wall having radial arms (illustrated and described herein by way of example as four in number) is constructed to a desired height (herein, two stories). The wall may be concrete blocks filled with concrete or poured concrete. A concrete slab may be laid extending perpendicular to each arm of the wall. Interior floors, ceilings and exterior room walls are erected and roof joists are supported by stud extensions of the masonry wall and the exterior and interior walls. The roof preferably slopes outward-downward from an apex directly above the top edge of the masonry wall. Economies in constructions and efficient use of land area are accomplished. Privacy of dwelling units, earthquake protection, fire hazard protection and heat and sound insulation are enhanced.

3 Claims, 6 Drawing Figures

BUILDING CONSTRUCTION FOR MULTIPLE UNITS HAVING COMMON WALLS

This invention relates to a new and improved building construction for multiple units having common walls.

In the drawings and description of this application, the building contains four units, each unit is two stories, and the interior is divided into rooms for dwellings. It will be understood, however, that the drawings and description are by way of example, and that more or less stories may be used, that the building is adapted for uses other than dwellings and that a greater or lesser number of units may be constructed.

A distinctive feature of the fourplex unit herein illustrated and described is the use of a central, masonry, cross-shaped wall having four arms to correspond to the four dwelling units. These arms constitute party walls between units, and are free-standing. The cross-shaped wall provides horizontal bracing for the entire building. It provides the principal support for the building. Seismic protection and fire hazard protection are enhanced.

The masonry wall may be formed of concrete blocks and rigidified by reinforcing rods and/or poured concrete. Alternatively, a poured concrete wall may be used.

Therefore, a feature of the invention is the fact that four adjacent units are constructed, but each unit has privacy so far as sound transmission from adjacent units is concerned, and the units are so located that visual privacy is also achieved. Heat and sound insulation are improved.

Individual units extend perpendicularly from each arm of the masonry wall. In a preferred construction, a concrete slab, constructed in accordance with conventional practice, is a base for interior and exterior walls and flooring. This slab provides suitable foundation for the external and interior walls of the unit. Although a concrete slab is a preferred construction, other flooring may be employed.

The exterior and interior walls are preferably erected on the slab and supported thereby, it being understood that suitable footings are formed in the bottom of the slab. The interior walls hereinafter described provide dwelling units on the ground level and, in addition, a flooring may be erected in the back of the unit to support additional dwelling rooms on a second story.

The roof of each unit slopes downwardly-outwardly from a position immediately above and in line with the top edge of each arm of the masonry wall. Preferably, stud extensions above the top edge of the wall support the inner ends of the roof joists.

As is apparent from the foregoing and from the drawings and description which follow, the present invention provides great economy in the construction of the units and also economizes on land use. All of these factors make the building of lower cost than buildings of similar capacity with comparable features.

Other objects of the present invention will become apparent upon reading the following specification and referring to the accompanying drawings in which similar characters of reference represent corresponding parts in each of the several views.

Figure 1:
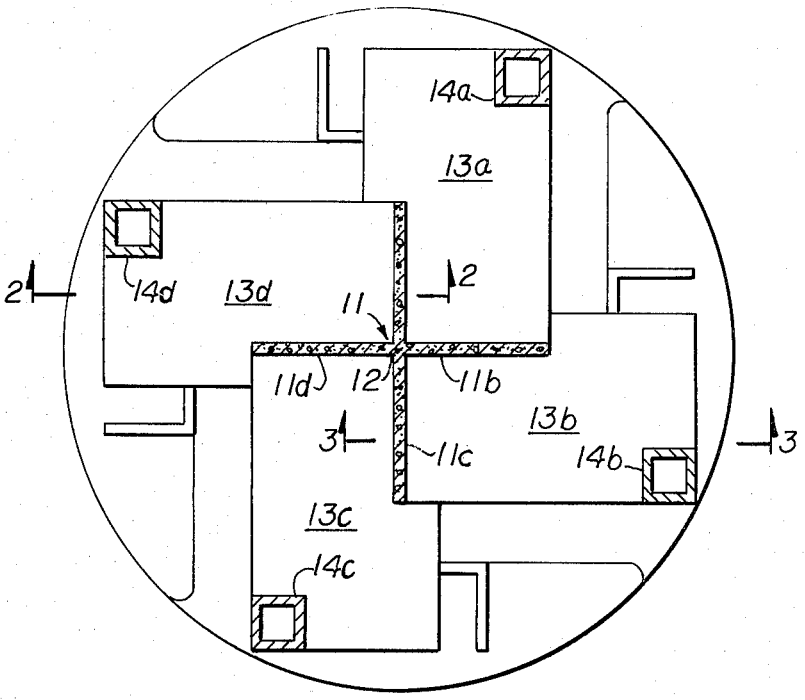
FIG. 1 is a schematic top plan view of the masonry wall and concrete slab foundation for a fourplex unit in accordance with the present invention.
Figure 6:
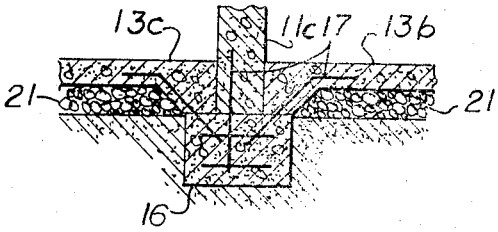
FIG. 6 is an enlarged fragmentary sectional view showing the foundation for one of the arms of the masonry wall and the concrete slabs.

A distinct feature of the present invention is the "pinwheel wall" construction, wherein a masonry wall 11 has (in the preferred embodiment hereof) four arms, 11*a, b, c,* and *d,* extending from a common vertical axis, 12. The arms 11 are preferably formed of concrete blocks filled with concrete and supported by reinforcing rods as is well understood in the masonry art. Alternatively, poured concrete may be used for the walls. Thus, the arms are fireproof, relatively soundproof, and provide a strong support for seismic and other stresses for the roof, interior flooring and the like without horizontal bracing. Extending perpendicularly outwardly from each arm 11*a–d* are the four units, each preferably located on concrete slabs 13*a–d*. The shape of slabs 13 is best shown in FIG. 1. Where desired, a fireplace may be incorporated in the design and the fireplace foundations 14*a–d* are shown in the corners of the slabs opposite axis 12. Directing attention to FIG. 6, a typical foundation for wall 11 is illustrated. A foundation 16 is laid parallel to each arm 11 and is tied into the arm by reinforcing rods 17 which also tie into the adjacent concrete slabs here shown as 13*b* and 13*c*. Slabs 13 are of conventional construction. As shown, under each slab 13 is an aggregate base 21, and at suitable intervals (referring to FIGS. 2 and 3) are footings 22 which support interior and exterior walls as hereinafter described.

Figure 2:
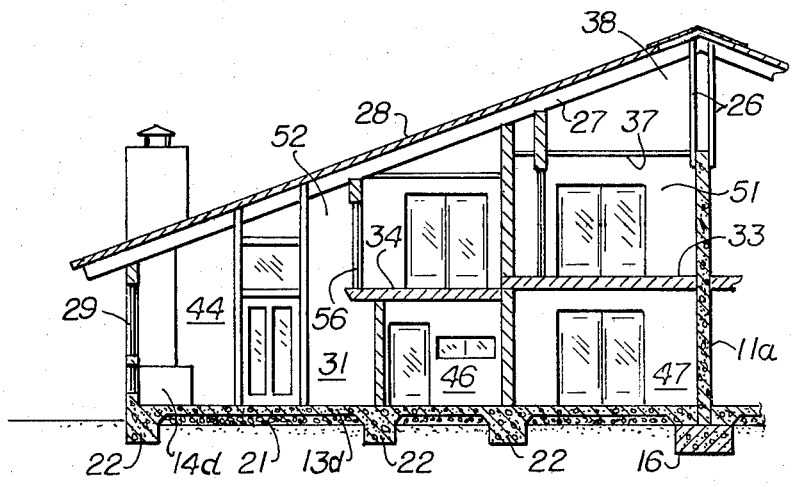
FIG. 2 is a vertical sectional view of a completed unit taken substantially along the lines 2—2 of FIG. 1.
Figure 3:
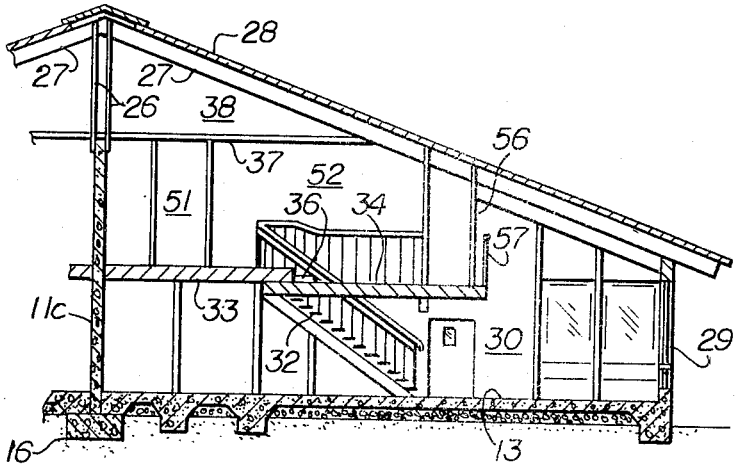
FIG. 3 is a view similar to FIG. 2 taken substantially along the lines 3—3 of FIG. 1.

Directing attention now to FIG. 2, a plurality of studs 26 extend vertically above the top edge of each masonry wall arm to reduce the height, and thus the cost of the masonry wall. For each unit, the roof slopes outwardly-downwardly from an apex above the top edge of wall 11*a*. As shown in FIG. 2, roof joists 27 slope from the upper edge of studs 26 outwardly, forming the support for the roof 28 and are supported at their outer ends by exterior front wall 29 which extends up from slab 13.

Figure 4:
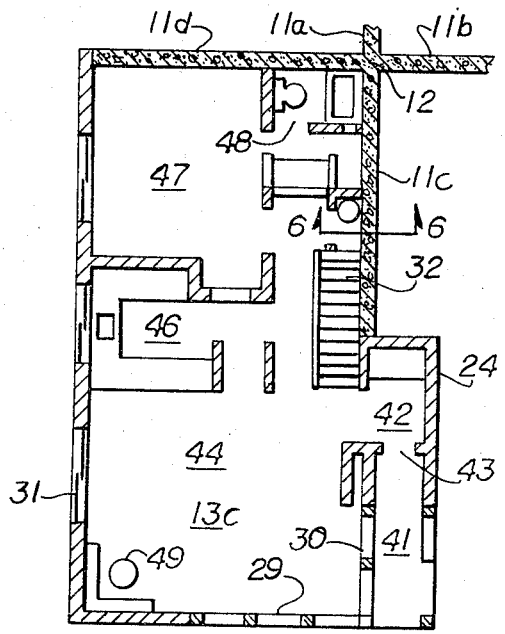
FIG. 4 is a schematic plan view of the ground floor of one of the units.
Figure 5:
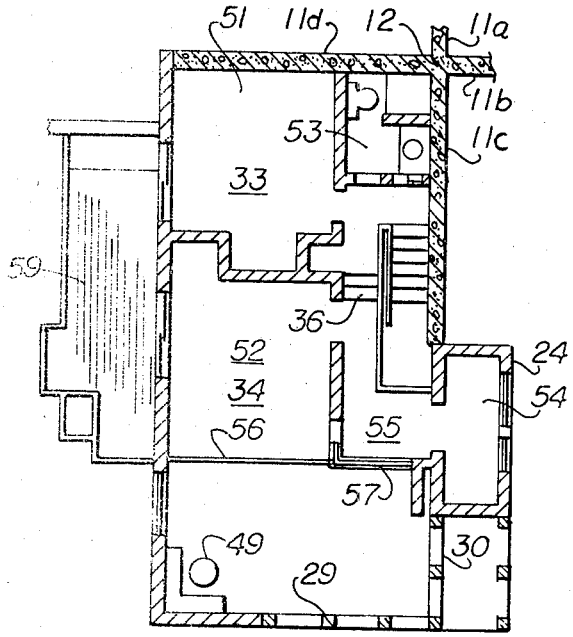
FIG. 5 is a schematic plan view of the upper floor of said unit.

An L-shaped extension 24 extends outwardly from the outer end of arm 11*c*, as illustrated in FIG. 4, coinciding with the edge of the slab 13*c*, shown in FIG. 1. An exterior wall 30 in line with arm 11*c* comprises one of the exterior side walls of each unit. The opposite exterior side wall 31 extends from the outer edge of arm 11*d* to the front edge of the slab 13*c*. Thus, the arms 11*c* and 11*d*, the front wall 29, and the side walls 30 and 31 define the rectangular shape of the unit. Exterior as well as interior walls may be of conventional wood framing or other construction. A covered passageway between a portion of the outer end of the extension 24 and the wall 30 may be provided for access to the unit, opening onto the entry-foyer 42 with the front door 43 located as indicated in FIG. 4.

In the preferred embodiment shown, there are two stories to each unit. A stairway 32 provides access to the upper rear floor 33 at the rear (see FIG. 3). As illustrated, there is a forward floor 34, at slightly lower elevation than floor 33, extending forwardly partway to the front wall 29. A few steps 36 permit travel between the floor 33 and the floor 34. The second story may be closed off by a ceiling 37 with an attic or storage space 38 above.

Directing attention now to the first floor plan shown in FIG. 4, the front room or living, dining room 44 is substantially two stories high, giving a spacious area. Interior walls provide a kitchen area 46, a lower story bedroom 47 and a bath 48. As heretofore mentioned, a fireplace 49 may be located in one corner of the living room 44.

In the second story is a rear bedroom 51 and an upstairs bath 53 supported by floor 33 and a front bedroom 52 supported by floor 34. A storage area, study or other room 54 may be located immediately above the entry foyer 42 at the level of floor 34. A hallway or passageway 55 interconnects the room 54 with the bedroom 52 and the stairs 36.

Instead of having a wall in the forward end of the upstairs bedroom 52 as an optional feature, a screen 56 may be provided which may be partially opened to increase the feeling of spaciousness of the quarters. Similarly, the forward edge of the hallway 55 may be provided with a railing 57 for similar function.

Leading off the bedrooms 51, 52 there may be a deck 59 preferably cantilevered from the wall 31.

It will be understood that the shape and number of the rooms and even the provision of the second story is optional depending upon the desired use of the facilities afforded.

Directing attention again to FIG. 1, it will be seen that each unit has privacy of access, a substantially soundproof and fireproof relationship with adjacent units, and yet great economy in construction and land use is achieved.

What is claimed is:

1. A multi-unit building comprising a free-standing central wall having a plurality of arms extending radially from a central vertical axis, said central wall comprising the principal support for the entire building and affording seismic protection, sound proofing, heat and sound insulation and fire hazard shielding for said entire building, a plurality of units, each unit extending perpendicularly from one said arm, a concrete slab for each said unit, a concrete-reinforced foundation around the perimeter of said slab including one stretch parallel to each said arm and the front exterior wall on each said one stretch, exterior walls around the perimeter of said slabs supported by said foundations, said central wall and said slabs being tied together with first reinforcing rods, said foundations and said slabs and said exterior walls being tied together by second reinforcements, a roof for each said unit supported by one said arm and by at least some of said exterior walls, said central wall being of masonry construction and being substantially fire, sound and earthquake proof, the exterior walls of individual units being separated from each other by arms of said central wall to reduce likelihood of fire spreading from one unit to another.

2. A building according to claim 1 in which said exterior walls include a front wall parallel to said one arm, said roof sloping downwardly toward said front wall so that said unit is higher at the rear than the front.

3. A building according to claim 1 which further comprises a floor at the rear of said unit dividing said unit into downstairs and upstairs quarters.

* * * * *